US012722067B2

(12) United States Patent
Gerhardt

(10) Patent No.: US 12,722,067 B2
(45) Date of Patent: Sep. 1, 2026

(54) SCORE TRACKING DEVICE FOR RACKET SPORTS AND RELATED METHODS

(71) Applicant: Rolland Gerhardt, San Diego, CA (US)

(72) Inventor: Rolland Gerhardt, San Diego, CA (US)

( * ) Notice: Subject to any disclaimer, the term of this patent is extended or adjusted under 35 U.S.C. 154(b) by 154 days.

(21) Appl. No.: 18/946,119

(22) Filed: Nov. 13, 2024

(65) Prior Publication Data

US 2025/0339754 A1 Nov. 6, 2025

Related U.S. Application Data

(60) Provisional application No. 63/641,068, filed on May 1, 2024.

(51) Int. Cl.

| | |
|---|---|
| ***A63B 71/06*** | (2006.01) |
| ***A63B 60/16*** | (2015.01) |
| ***A63B 60/46*** | (2015.01) |
| *A63B 102/02* | (2015.01) |
| *A63B 102/08* | (2015.01) |

(52) U.S. Cl.

CPC ..... *A63B 71/0669* (2013.01); *A63B 60/16* (2015.10); *A63B 60/46* (2015.10); *A63B 2071/0658* (2013.01); *A63B 2071/0694* (2013.01); *A63B 2102/02* (2015.10); *A63B 2102/08* (2015.10); *A63B 2220/808* (2013.01); *A63B 2225/74* (2020.08)

(58) Field of Classification Search

CPC ..... A63B 71/0669; A63B 60/16; A63B 2071/0658; A63B 2102/08; A63B 2220/808; A63B 2225/74; A63B 60/46; A63B 71/0622; A63B 2071/0694; A63B 2102/02

See application file for complete search history.

(56) References Cited

U.S. PATENT DOCUMENTS 4,189,143 A 2/1980 Van Auken et al.
4,237,372 A * 12/1980 Zevgolis ..... H03K 23/66 377/5

(Continued)

FOREIGN PATENT DOCUMENTS

DE 102004010966 A1 3/2004
EP 0024552 A1 8/1979

OTHER PUBLICATIONS

Amazon: https://www.amazon.com/FUMELPRO-Mounted-Points-numbers-Adhesive-without/dp/B0CJQ1M4PY Score Keeper for Tennis Racket and Padel, Easily Mounted Small Score Board to Keep Score of Points.numbers carved by Laser, bonded with strong Adhesive without Falling off, the Best Tennis Gift, Fumelpro, Dated Sep. 24, 2023.

*Primary Examiner* — Carl V Larsen
(74) *Attorney, Agent, or Firm* — Allison M. Corder

(57) ABSTRACT

A device for tracking score in racket sports, the device adapted to be mounted on an end cap of a handle grip of a racket, and the device comprising a display screen and a plurality of manually manipulatable buttons including a power button and a tally button. The display screen includes values representing a first value representing a score of a serving player, a second value representing a score of an opposing player, and a third value representing the serving player number.

18 Claims, 4 Drawing Sheets

(56) References Cited

U.S. PATENT DOCUMENTS

| | | | | |
|---|---|---|---|---|
| 5,134,565 | A * | 7/1992 | Herbertz | G04G 9/0064 273/DIG. 26 |
| 5,646,911 | A * | 7/1997 | Davis | A63B 49/08 473/553 |
| 6,012,995 | A * | 1/2000 | Martin | A63B 71/0669 377/5 |
| 7,773,461 | B1 * | 8/2010 | Crosby, Sr. | A63B 71/0669 368/10 |
| 11,400,358 | B1 | 8/2022 | McKay et al. | |
| 11,940,762 | B2 * | 3/2024 | Walklin | G10G 7/02 |
| 2005/0054457 | A1 * | 3/2005 | Eyestone | A63B 60/16 473/131 |
| 2007/0032893 | A1 * | 2/2007 | Lowran | A63B 71/06 700/91 |
| 2007/0265120 | A1 * | 11/2007 | Hickey | A63B 60/54 377/5 |
| 2013/0192514 | A1 * | 8/2013 | Murdough | G09F 11/00 116/222 |
| 2016/0346690 | A1 * | 12/2016 | Ramachandran | A63B 71/0669 |
| 2019/0168099 | A1 * | 6/2019 | Lutze | A63B 1/00 |
| 2021/0113911 | A1 * | 4/2021 | Madsen | A41D 20/00 |
| 2021/0354024 | A1 * | 11/2021 | Goodwin | A63B 71/0622 |
| 2022/0043401 | A1 * | 2/2022 | Walklin | A63B 24/0062 |
| 2024/0342580 | A1 * | 10/2024 | Brown | A63B 71/0669 |
| 2025/0339755 | A1 * | 11/2025 | Adams | A63B 71/0669 |
| 2025/0360390 | A1 * | 11/2025 | Lavers | A63B 71/0669 |

* cited by examiner

SCORE TRACKING DEVICE FOR RACKET SPORTS AND RELATED METHODS

REFERENCE TO RELATED APPLICATIONS

This application claims the benefit of U.S. Provisional Patent Application 63/641,068 filed May 1, 2024, incorporated by reference.

FIELD OF THE INVENTION

The invention relates to sports and sporting equipment. More specifically, the invention relates to a device and related methods for tracking scores during racket sports.

BACKGROUND OF THE INVENTION

Racket sports are games that are played with a racket or paddle to hit an object like a ball. There are a variety of racket sports, including tennis, squash, racquetball, ping pong, padel, pickleball, badminton, and platform tennis to name a few.

These racket sports require a racket each player uses to play the game. Rackets are constructed of a frame including a handle connected to an open loop. The open loop supports either a woven network of strings, a pattern of perforated holes, or a solid form. It is also known that the open loop may include or be covered with a textured surface. The handle is an elongated member usually with a grip portion and terminates at a butt end, or base end, otherwise referred to as an end cap.

While some racket sports, like racquetball, are played on an enclosed court, other racket sports are played on an open court and include a centrally located net. Players are located on opposing sides of the net while using the racket to volley the object, or ball, back-and-forth over the net.

Regardless of the racket sport played, score is tracked to determine a winner. However, a reoccurring problem is that players forget the score and who has the serve. It is difficult for players to rely on memory to keep score since this distracts from the mental preparedness of the game. And the momentum of the game is disrupted when having to stop the game to write down or discuss the score. There is no need for players to argue about the score of the game.

While scoring mechanisms are known, there are disadvantages with these prior art designs. For example, the Portable Score Indicator of EP0024552A1 discloses an aftermarket component attached to a racket and including concentrically circular-arc-shaped slots with moveable locking buttons with portions that protrude, more than slightly, from the racket. This may be obtrusive, uncomfortable, and/or distracting during play, and may affect a player's grip by being located on the handle of the racket. The protrusions may also affect the weight distribution or center of gravity of the racket requiring the player to compensate for this during play. And the moveable locking buttons are small making it difficult to manipulate within the circular-arc-shaped locking slots.

Another reference, Tennis Scorekeeper of U.S. Pat. No. 4,189,143A, also discloses an aftermarket component with an adhesive layer for attaching to the racket, that again, may be obtrusive, uncomfortable, and/or distracting during play. The scoring mechanism records game points for both teams and records games and sets won by the teams. The scoring mechanism is divided into two groups of four so that there are a total of eight indexing buttons or slides to track the score. Eight buttons are not only numerous, but cumbersome and time consuming to operate.

Reference U.S. Pat. No. 11,400,358B1 directed to a Pickleball Scorekeeping Device and Method includes moveable objects on a sweatband to track the score. Two rows track each team's score-one bead is moved downward as each point is scored until the last bead is reached, denoting a winner. A third row has two beads moveable to indicate which team is serving. The scoring mechanism is disclosed as being located on a sweatband, which is apparel that a player may forget to wear or may become destroyed during washing. Moreover, the beads are small making it difficult to see and operate.

What is needed is a device and related methods for tracking scores during racket sports that overcomes the disadvantages of the prior art. The invention satisfies this need.

SUMMARY OF THE INVENTION

The invention is directed to a device and related methods for tracking scores during racket sports. The score tracking device may be a separate component, like an after-market product, which is mounted or assembled to the racket. Or it may be integrated, or built-into, the racket. A device built-into the racket may be constructed at time of manufacturing of the racket preventing it from breaking or disconnecting from the racket during play. However, it is contemplated that the invention may be a wearable device configured to be worn on clothing such as a shirt, hat, or wristband.

The score tracking device comprises a body. The body includes a surface with a display and buttons. The display communicates number values, and one or more buttons are used to change the digits of the number values. The buttons may be recessed below the surface or protrude slightly to reduce or eliminate accidental or inadvertent activation.

The score tracking device may be located at the end or bottom of the handle to prevent interference with the player's hands when gripping the shaft or handle of the racket during play of the game.

The score tracking device may be constructed from a lightweight material or combination of materials so as to not contribute a significant amount of weight to the racket.

The score tracking device may include components of different colors and/or shapes to either aesthetically coincide with the racket, or to assist with identifying the score of each team or player.

It is also contemplated that the invention may be an aftermarket device with an attachment means for mounting to a pre-owned racket. Other embodiments may include a digital display, a solar or battery-operated or rechargeable device, or even a voice activated/recognition device such as voice to text technology.

The score tracking device according to the invention tracks the score with complete accuracy for each player or team.

These and other objects, features, and advantages of the present invention will become more readily apparent from the attached drawings and from the detailed description of the preferred embodiments which follow.

DETAILED DESCRIPTION OF THE INVENTION

Figure 1:
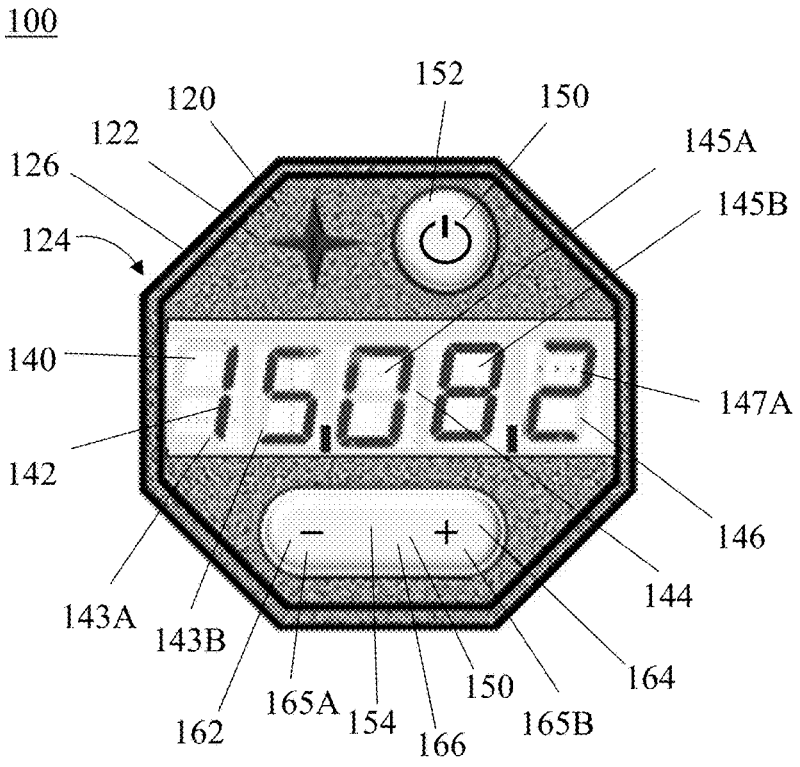
FIG. 1 is a front view of a score tracking device according to one embodiment of the invention.

The invention is discussed with respect to pickleball for exemplary purposes only. Any racket sport is contemplated.

In pickleball, a winner is the first player to achieve 11 points and must win by 2 points. Each rally begins with a serve by the serving player. Only the serving player can score a point by winning a rally. The game may be played as singles or doubles. In doubles each player on a team has a chance to serve. Before each serve, the score is called out as a sequence of three numbers: 1. serving player score, 2. opposing player score, 3. player's server number (one or two). For purposes of this application, the term "player" may be either a single player or a team of two players.

FIG. 1 through FIG. 5 illustrate various contemplated embodiments of the device for tracking score in racket sports according to the invention.

The device 100 includes a body 120 including a top surface 122, a bottom surface 124, and a side surface 126. The body 120 may be fabricated from any durable material such as plastic, rubber, metal, or any combination thereof, and with features such as water-resistant.

The top surface 122 includes a display screen 140 and a plurality of manually manipulatable buttons 150. The display screen 140 may be digital and include a light-emitting diode (LED). Other types of display screens are also contemplated such as an organic light-emitting diode (OLED) and Quantum Dot LED (QLED), to name a few.

The display screen 140 is operable through a circuit housed within the body 120. The circuit may be powered through any known power source; for example, batteries installed through a removable panel 171 in the bottom surface 124 shown in FIG. 7. A rechargeable device 100 is also contemplated, such as that using a charging port 173 located on the side surface 126. Solar power is also an option.

The display screen 140 includes a first number value 142 representing a first score of a first player, a second number value 144 representing a second score of a second player, and a third number value 146 representing the server number.

Both the first value 142 and the second value 144 comprise two number digits. The first value includes a first digit 143A and a second digit 143B each numbered 0 through 9, so that in combination they may read a low of 00 or a max of 99. Similarly, the second value 144 includes a third digit 145A and a fourth digit 145B each numbered 0 through 9, so that in combination they may read a low of 00 or a max of 99. The third value 146 includes a fifth digit 147A numbered 1 or 2.

The display screen 140 may be a single unitary portion or broken into two or more portions 141A, 141B, 141C with each portion including one or more number values 142, 144, 146. For example, wherein the display screen 140 comprises three separate portions 141A, 141B, 141C with a first portion 141A consisting of the first value 142 that includes a first digit 143A and a second digit 143B, a second portion 141B consisting of the second value 144 that includes a third digit 145A and a fourth digit 145B, and a third portion 141C consisting of the third value 146 that includes a fifth digit 147A, which is a 1 or a 2. Or, wherein the display screen 140 comprises two separate portions 141A, 141B with a first portion 141A consisting of a first value 142 that includes a first digit 143A and a second digit 143B and a second value 144 that includes a third digit 145A and a fourth digit 145B, and the second portion 141B consisting of the third value 146 that includes a fifth digit 147. On the body 120, the portions 141A, 141B, 141C may be arranged with one another horizontally (side by side) or vertically (up and down), or both.

The manually manipulatable buttons 150 include a power button 152 and a tally button 154. The power button 152 is circular shape as shown in FIG. 1-FIG. 4, or oval shape as shown in FIG. 5 to make it easier for players to manipulate with the tip of their finger. The power button 152 is configured to switch between a first state in which the device 100 is 'on' and a second state in which the device 100 is 'off'. When the device 100 is 'on', the display screen 140 illuminates the digits 143A, 143B, 145A, 145B, 147A of the number values 142, 144, 146.

Figure 2:
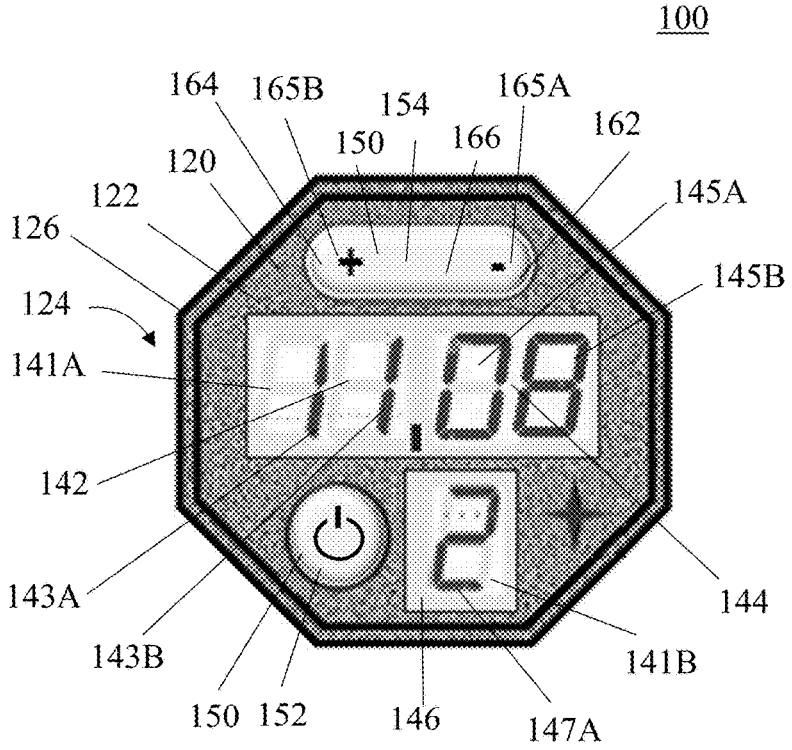
FIG. 2 is a front view of a score tracking device according to another embodiment of the invention.
Figure 3:
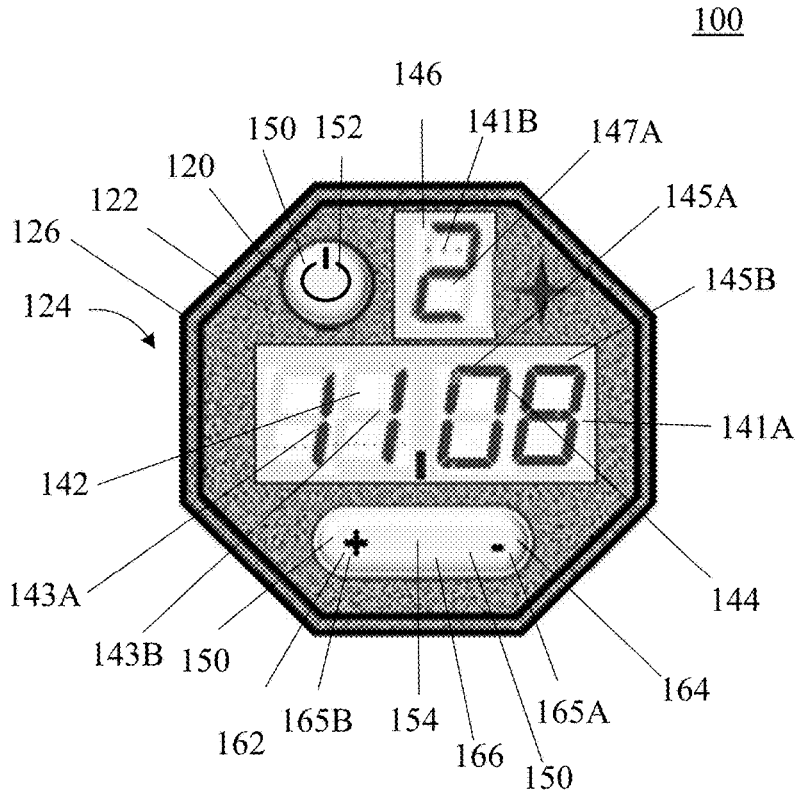
FIG. 3 is a front view of a score tracking device according to another embodiment of the invention.

The tally button 154 is configured to increase or decrease the first value 142, the second value 144, and the third value 146, specifically by changing the digits 143A, 143B, 145A, 145B, 147A of the number values 142, 144, 146. As shown in FIG. 1-FIG. 3, the tally button 154 is an elongated oval shape so that players may easily slide their fingers across its length. The tally button 154 includes a first end 162 and a second end 154 with each end 162, 164 including indicia indicating how the number values 142, 144, 146 are changed when either end 162, 164 of button 154 is manipulated.

The first end 162 includes a negative or minus (−) indicia 165A indicating the value decreases when the first end 162 is manipulated. When the second end 164 is manipulated, the value increases as indicated by a positive or plus (+) indicia 165B. Either end 162, 164 may be used to increase or decrease the values, for example, FIG. 3 illustrates an embodiment in which the first end 162 includes a positive or plus (+) indicia 165B and the second end 164 includes a negative or minus (−) indicia 165A. As applied to pickleball, the first number value 142, second number value 144, and third number value 146 increase or decrease by 1 when the tally button 154 is manipulated.

Figure 4:
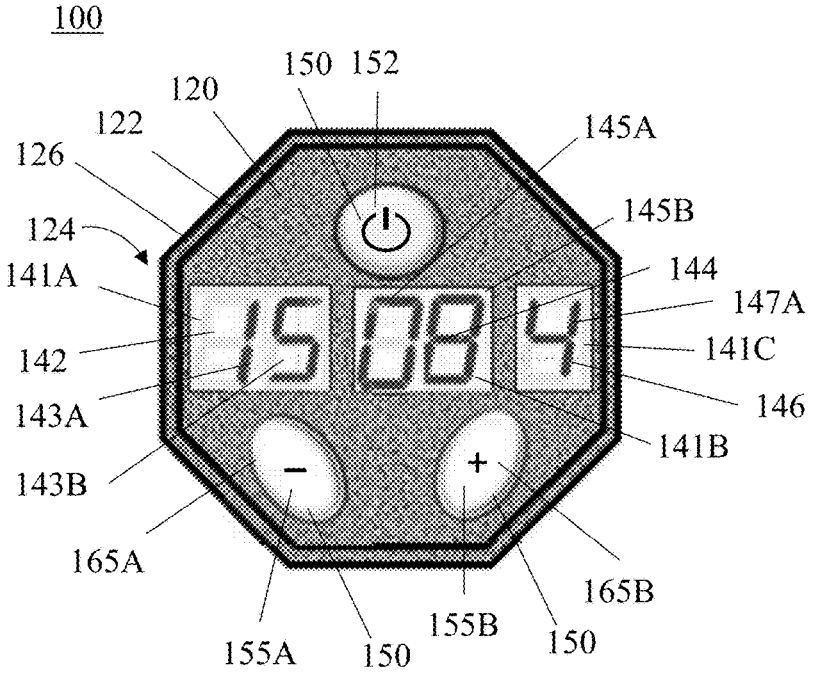
FIG. 4 is a front view of a score tracking device according to another embodiment of the invention.
Figure 5:
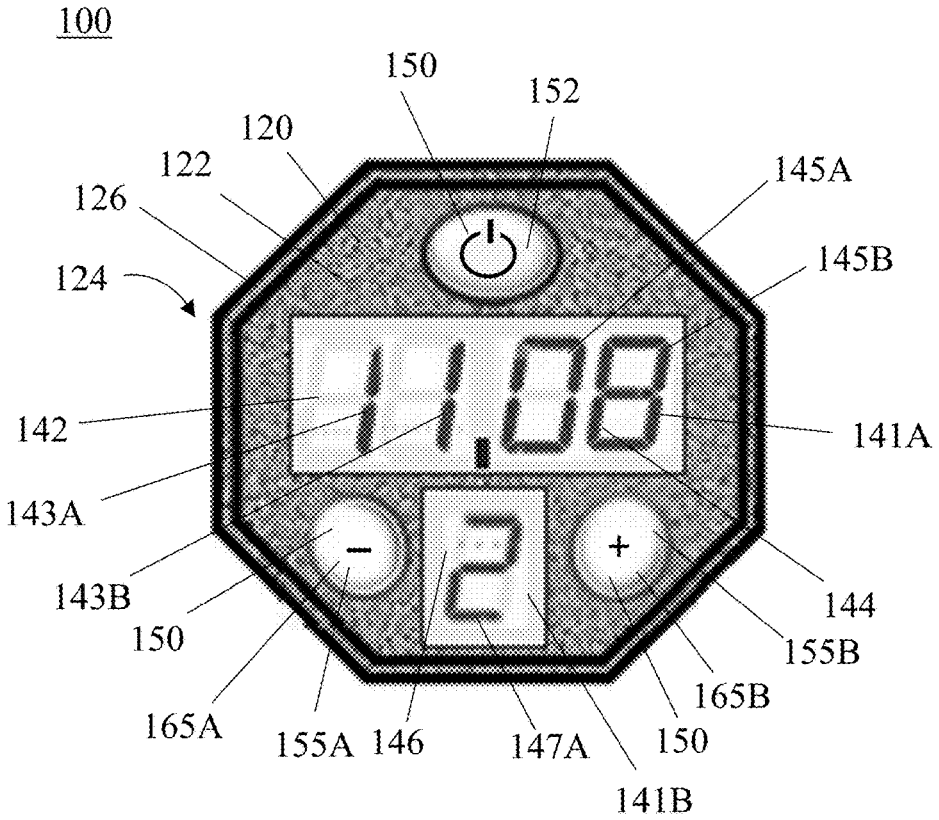
FIG. 5 is a front view of a score tracking device according to another embodiment of the invention.

As shown in FIG. 4 and FIG. 5, the tally button 154 may comprise two separate buttons 155A, 155B. These buttons 155A, 155B are circular shape to make it easier for players to manipulate with the tip of their finger. A first tally button 155A with a negative or minus (−) indicia 165A is configured to decrease the first value 142, the second value 144, and the third value 146, and a second tally button 155B with a positive or plus (+) indicia 165B configured to increase the values 142, 144, 146.

To change between the first value 142, the second value 144, and the third value 146, one or more of the buttons 150 may be used to toggle between them. For example, the power button 152 may include a quick manipulation to toggle between the first number value 142, the second number value 144, and the third number value 146, while requiring a "press and hold" manipulation to turn the device 100 'on' and 'off'.

As shown in FIG. 1 through FIG. 3, a middle portion 166 of the tally button 154 residing between the first end 162 and the second end 164 may be manipulated to toggle between the values 142, 144, 146. Once the desired value 142, 144, 146 is toggled to, the tally button 154 is used to increase by 1 or decrease by 1 the first value, the second value, and the third value.

While tally buttons 154 are shown, it is also contemplated that a voice activated/recognition system such as voice to text technology may be used. For example, when a player speaks the score, it is recorded through a speaker element 174 shown in FIG. 7 and translated to the digits 143A, 143B, 145A, 145B, 147A of the number values 142, 144, 146 shown on the display screen 140.

Figure 6A:
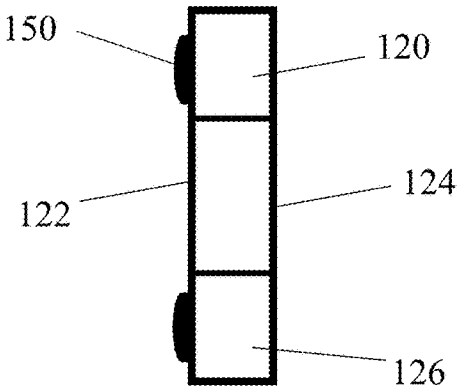
FIG. 6A is a side view of a score tracking device according to one embodiment of the invention.
Figure 6B:
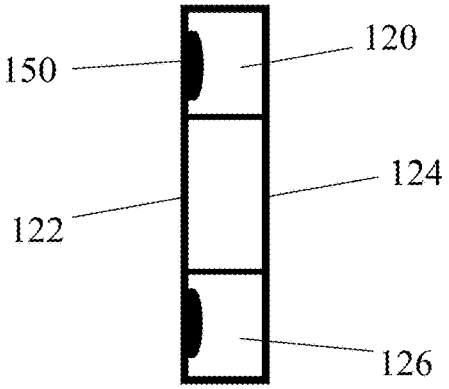
FIG. 6B is a side view of a score tracking device according to another embodiment of the invention.
Figure 8:
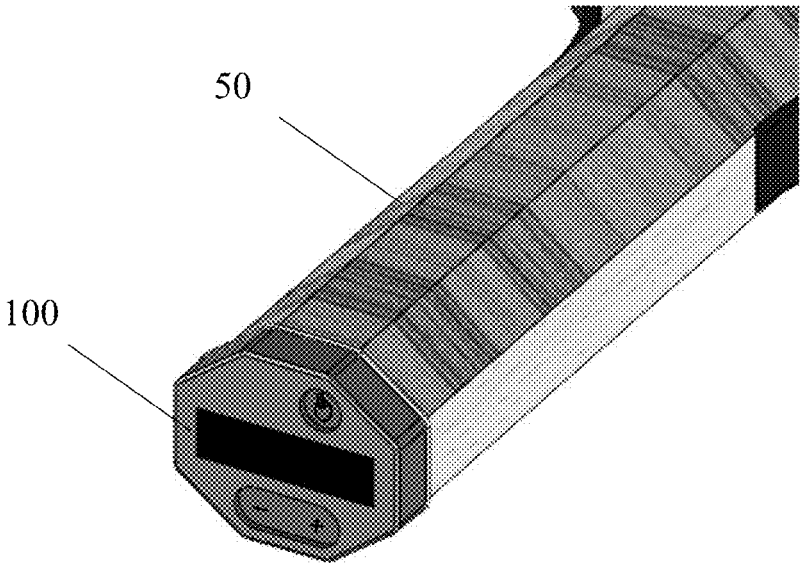
FIG. 8 is a perspective view of a score tracking device mounted to a handle of a racket according to the invention.

As shown in FIG. 6A, the buttons 150 may slightly protrude from the top surface 122 of the body 120. This permits a player to locate the buttons 150 through the sense of touch. While a player may feel for the buttons 150 that slightly protrude, the same goes for buttons 150 that are slightly recessed from the top surface 122 of the body 120 as shown in FIG. 6B and FIG. 8. And recessed buttons may prevent accidental or inadvertent activation.

Figure 7:
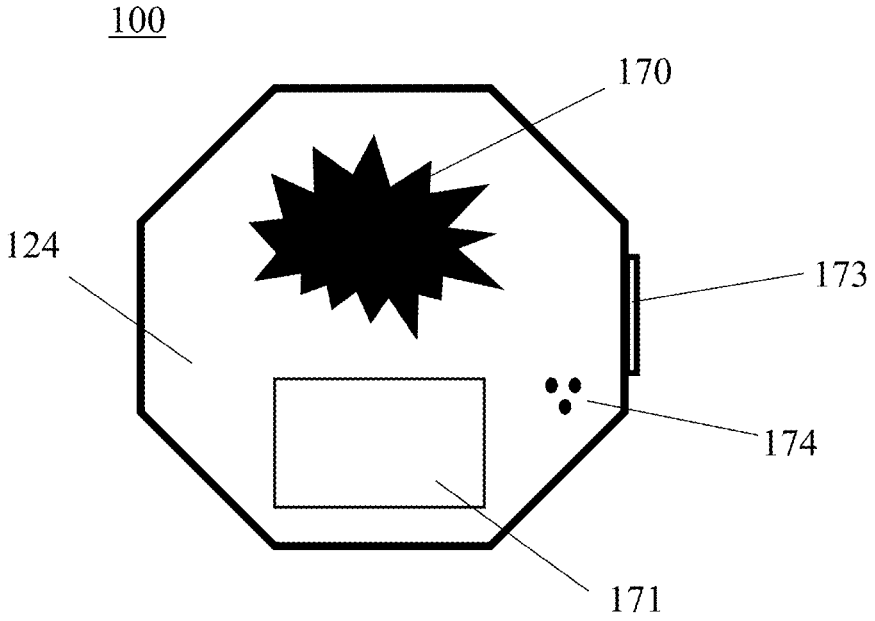
FIG. 7 is a rear view of a score tracking device according to the invention.

While the device 100 may be integrated or built-into a racket, the device may also be an after-market product that players mount on or assemble to an end cap of a handle grip of a racket using a connection element 170 as shown in FIG. 7. The connection element 170 may be adhesive to permanently attach the device 100 to the end cap, or it may be a removeable attachment means such as a hook-and-loop fastening system. FIG. 8 illustrates the device 100 installed on the end cap of a racket 50.

FIG. 1 through FIG. 5 illustrate various contemplated embodiments of the device 100 for tracking score in racket sports according to the invention. Buttons 150 may be positioned above or below the display screen 140, or both above and below the display screen 140. And in certain embodiments, buttons 150 may be in a side-by-side relationship with each other, or with portions 141A, 141B, 141C of the display screen 140.

As shown in FIG. 1, the display screen 140 is a single unitary portion consisting of the first value 142, the second value 144, and the third value 146. As shown in FIG. 1, the power button 152 is located above the display 140 and the tally button 154 is located below.

As shown in FIG. 2, the display screen 140 comprises two separate portions 141A, 141B with a first portion 141A consisting of both the first value 142 and the second value 144, and a second portion 141B consisting of the third value 146. The power button 152 is located both below display portion 141A and in a side-by-side relationship with another display portion 141B. The tally button 154 is located above both the display portions 141A, 141B.

As shown in FIG. 3, the display screen 140 comprises two separate portions 141A, 141B with a first portion 141A consisting of both the first number value 142 and the second number value 144, and a second portion 141B consisting of the third number value 146. The power button 152 is located both above display portion 141A and in a side-by-side relationship with another display portion 141B. The tally button 154 is located below the display portions 141A, 141B.

As shown in FIG. 4, the display screen 140 comprises three separate portions 141A, 141B, 141C with a first portion 141A consisting of the first value 142 and the second portion 141B consisting of the second value 144, and a third portion 141C consisting of the third value 146. The power button 152 is located above the display portions 141A, 141B, 141C. The tally button 154 comprises separate buttons 155A and 155B that are each located below the display portions 141A, 141B, 141C. The first tally button 155A and the second tally button 155B are in a side-by-side relationship.

As shown in FIG. 5, the display screen 140 comprises two separate portions 141A, 141B with a first portion 141A consisting of both the first value 142 and the second value 144, and a second portion 141B consisting of the third value 146. The power button 152 is located above the display portions 141A, 141B. The tally button 154 comprises two separate buttons 155A and 155B and are each located below the first display portion 141A. And the second display portion 141B is also located below the first display portion 141A. Specifically, the first tally button 155A, the second tally button 155B, and the second display portion 141B are in a side-by-side relationship with the second display portion 141B located between the first tally button 155A and the second tally button 155B.

While the disclosure is susceptible to various modifications and alternative forms, specific exemplary embodiments of the invention have been shown by way of example in the drawings and have been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

The invention claimed is:

1. A device for tracking score in racket sports, the device adapted to be mounted on an end cap of a handle grip of a racket, and the device comprising:

a body including a top surface, a bottom surface, and a side surface;

the bottom surface including a connection element for mounting the device on the end cap of the handle grip of the racket;

the top surface comprising a display screen and a plurality of manually manipulatable buttons;

the display screen including a first value representing a first score of a serving player, a second value representing a second score of an opposing player, and a third value representing the serving player number, wherein the display screen includes a light-emitting diode (LED);

wherein the plurality of manually manipulatable buttons includes a power button and a tally button, the power button configured to switch between a first state in which the device is 'on' and a second state in which the device is 'off', the tally button configured to increase or decrease the first value, the second value and the third value, wherein one of the power button and tally button is configured to toggle between the first value, the second value, and the third value.

2. The device according to claim 1, wherein the light-emitting diode (LED) is an organic light-emitting diode (OLED).

3. The device according to claim 1, wherein the racket sport is pickleball.

4. The device according to claim 1, wherein the power button is a circular shape.

5. The device according to claim 1, wherein the tally button is an elongated oval shape.

6. The device according to claim 1, wherein the tally button increases by 1 or decreases by 1 the first value, the second value, or the third value.

7. The device according to claim 1, wherein the tally button comprises two separate buttons, a first button configured to increase by 1 the first value, the second value and the third value, and a second button configured to decrease by 1 the first value, the second value and the third value.

8. The device according to claim 1, wherein the display screen comprises two separate portions with a first portion consisting of both the first value and the second value, and a second portion consisting of the third value.

9. The device according to claim 1, wherein the display screen comprises three separate portions with a first portion consisting of the first value, a second portion consisting of the second value, and a third portion consisting of the third value.

10. The device according to claim 1, wherein the power button is positioned above the display screen and the tally button is positioned below the display screen.

11. The device according to claim 1, wherein the power button is positioned below the display screen and the tally button is positioned above the display screen.

12. The device according to claim 1, wherein the power button is positioned in a side-by-side relationship with the third value.

13. The device according to claim 1, wherein the tally button is positioned in a side-by-side relationship with the third value.

14. The device according to claim 1, wherein the first tally button and the second tally button are positioned in a side-by-side relationship with a portion of the display screen.

15. The device according to claim 1, wherein at least one of the power button and the tally button are recessed from the top surface.

16. The device according to claim 1, wherein the first value consists of a first digit and a second digit, the second value consists of a third digit and a fourth digit, and the third value consists of a fifth digit.

17. The device according to claim 16, wherein the fifth digit is a number 1 or a number 2.

18. A method for tracking score in racket sports, the method comprising:

providing a device mounted on an end cap of a handle grip of a racket, the device comprising a display screen and a power button and a tally button, the display screen including a first value representing a first score of a serving player, a second value representing a second score of an opposing player, and a third value representing the serving player number;

manipulating the power button to turn the device in a first 'on' state;

activating one of the power button and the tally button to toggle between the first value, the second value, and the third value;

using the tally button to increase by 1 or decrease by 1 the first value, the second value, and the third value; and manipulating the power button to turn the device in a second 'off' state.

* * * * *